United States Patent [19]

Weng

[11] Patent Number: 4,946,573

[45] Date of Patent: Aug. 7, 1990

[54] PUMP-ATTACHED DIPOLE ELECTRO-PLATING BARREL

[76] Inventor: Evans Weng, No. 1, Alley 4, Lane 63, Fu Hsin Rd., Taipei, Taiwan

[21] Appl. No.: 464,064

[22] Filed: Jan. 12, 1990

[51] Int. Cl.[5] ..... C25D 17/20

[52] U.S. Cl. ..... 204/213

[58] Field of Search ..... 204/213

[56] References Cited

FOREIGN PATENT DOCUMENTS 2744218 4/1979 Fed. Rep. of Germany .

*Primary Examiner*—T. M. Tufariello

*Attorney, Agent, or Firm*—Varndell Legal Group

[57] ABSTRACT

A pump attach dipole electro-plating barrel, which includes a flexible impeller vane pump driven by the barrel to constantly pump outside plating solution into the barrel so as to equalize the concentration of the plating solution internally as well as externally. Several electrodes are positioned in the barrel to alternatively connect with the anode and cathode through an electric polarity changing device, so that the metal films which is deposited onto the electrodes during the rotation of temporary cathode can be automatically electrolyzed from the electrodes through the change of electric polarity connection to minimize the consumption of anode metal and metal ion in bath.

6 Claims, 4 Drawing Sheets

PUMP-ATTACHED DIPOLE ELECTRO-PLATING BARREL

BACKGROUND OF THE INVENTION

The present invention is related to a pump-attached dipole electro-plating barrel for use in electro-plating process.

In conventional horizontal rotary plating techniques, a barrel is used for depositing a coating of metal on by electrode. In a variety of contactor of electrode, such as centerod type, dangler contact type, side contact type, grid contact type, or bottom contact type, a satisfactory performance is still difficult to achieve.

According to conventional methods, slinder working pieces tend to be obstructed and bent by the lead wires or center rod in a rotary barrel during tumbling of operation or unloading. Besides, because the area of contractor of cathode is restricted, the working pieces to be plated will get a high gradient in the distribution of thickness. Further, the contactor of cathode of a conventional electro-plating barrel may be gradually built-up due to operation for a period.

In the bottom contact type, high gradient in the distribution of thickness may be eliminated. But because the electrodes in a rotary barrel are connected in parallel and simultaneously charged with negative electricity, and the working pieces generally fall to the bottom area inside the barrel during electro-plating operation, the electrodes which are turned to an upper position spaced from the working pieces below may cause a phenomenon of ultra high current density. As a consequence of such an ultra high current density, burnt deposit forms around the electrodes and will interfere with the operation of electro-plating process. Therefore, the electrodes must be periodically replaced with new ones or well treated to remove the build-up layer therefrom. It is indeed very troublesome to dismount the electrodes from an electro-plating barrel. During cleaning process, certain tools or chemicals may be required. Further, the build-up on electrode simultaneously increases the consumption of anode metal or metal ion in bath. Also in the bottom contact type, electro-plating solution level may be adjusted during electro-plating process and the upper raws of electrode may be left from the plating bath, to reduce possible depositing of metal complex on the electrodes. In fact, not only the difficulty in controlling the bath level, but also the air being compressed into the electro-plating solution, certain type of electro-plating solutions is not suitable for such operation. For example, anaerobic electro-plating solution (cyanide solution or tin sulfite solution) is not suitable for use in bath level controlling process.

In comparison with rack plating, the conventional horizontal electro-plating rotary barrel is relatively inferior in performance since the circulation of outside electro-plating solution with inner electro-plating solution is interfered and the current path between the anode and cathod is obstructed. Regular horizontal electro-plating rotary barrel is generally made of plastic sheet perforated with small holes or relatively bigger holes linned with mesh clothes to prevent from dropping of working pieces during electro-plating process. However, the holes made on the barrel are not sufficient enough so that good circulation of electro-plating solution can not be well performed through the barrel. As a consequence of poor circulation of electro-plating solution and poor current efficiency high quality of electro-plating effect can not be achieved.

Therefore, the main object of the present invention is to provide such a pump-attached dipole electro-plating barrel which can automatically electrolyze any metal which deposited on the electrodes so as to minimize the consumption of anode metal or metal ions in bath.

Another object of the present invention is to provide such a pump-attached dipole electro-plating barrel which utilizes a flexible impellar vane pump to constantly pump outside plating solution into the barrel so as to equalize the concentration of the plating solution internally as well as externally.

SUMMARY OF THE INVENTION

In accordance with the present invention, a pump-attached dipole electro-plating barrel includes a cylinder: a gear portion engaged with a speed change gear carried to rotate by a motor power source; a hexad of electrodes which is insoluble in electrolyte positioning in the cylinder; a carbon brush type electric polarity changing device alternatively connected to a rotating electric distributor which is coupled with the electrodes; and a flexible impeller vame pump having an inlet pipe dipped in the plating solution, and an outlet pipe positioned in the central axis of the cylinder. Through the effect of the flexible impeller vame pump, the plating solution inside the cylinder is constantly equalized with the plating solution outside the cylinder so as to maintain a balanced concentration. Through the effect of the electric polarity changing device, the electrodes are alternatively changed their polarity, so that the metal deposited on the electrode can be automatically electrolyzed from the electrodes during operation.

DETAILED DESCRIPTION OF THE INVENTION

Figure 1:
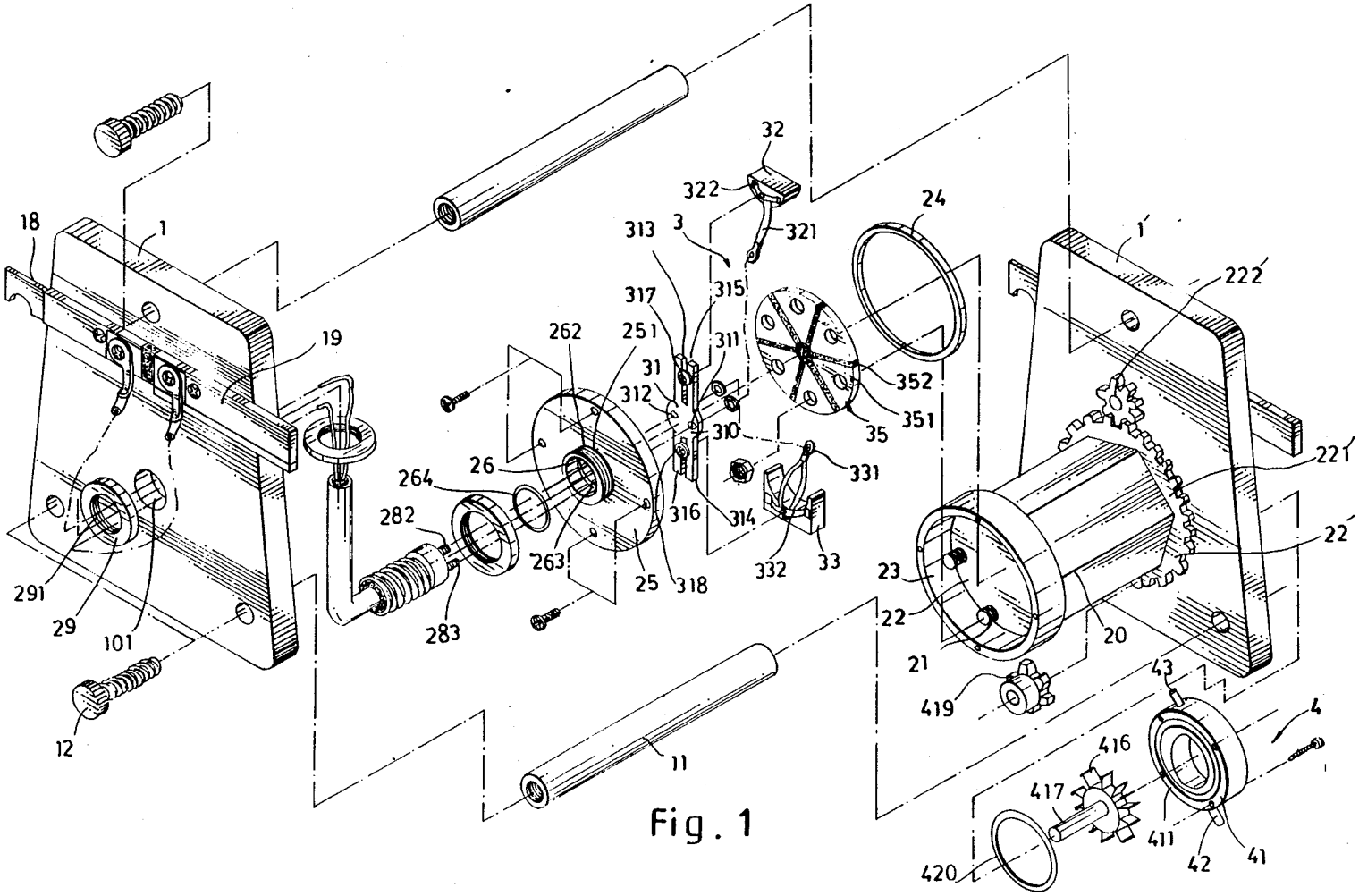
FIG. 1 is a perspective exploded view of a pump-attached dipole electro-plating barrel embodying the present invention.
Figure 2:
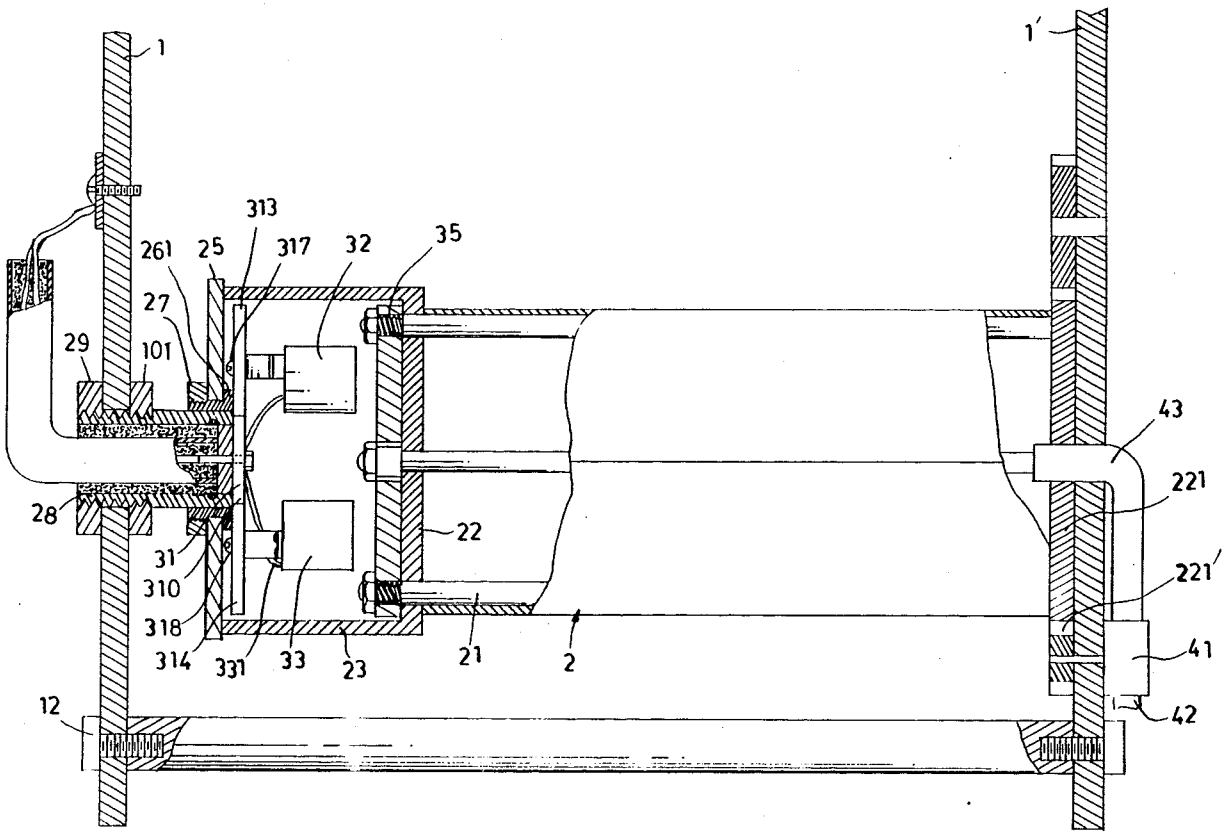
FIG. 2 is a sectional assembly view of the embodiment of FIG. 1.
Figure 3:
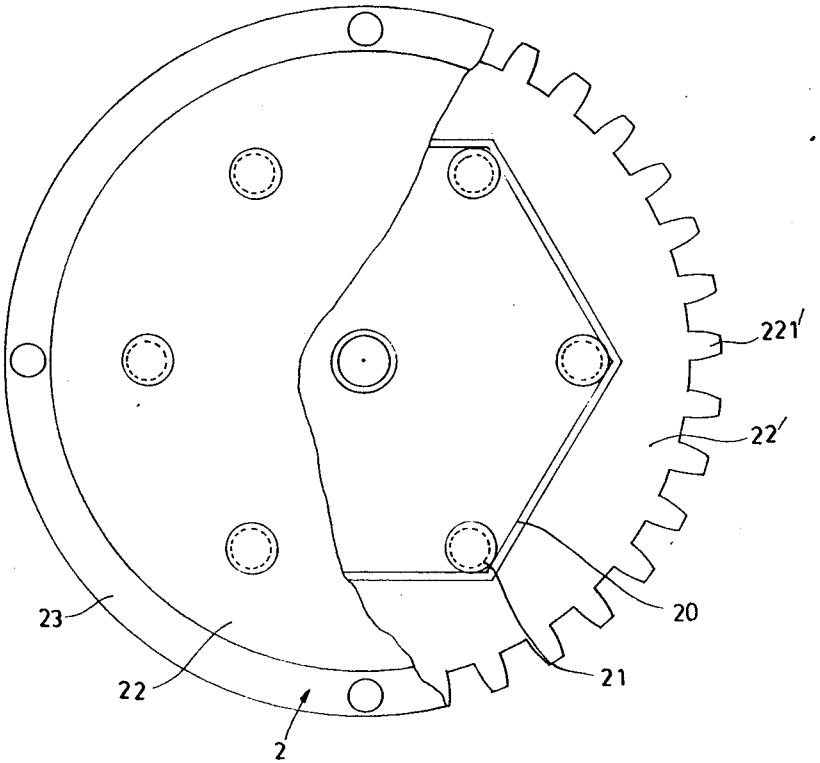
FIG. 3 is an end-sectional view of the embodiment of FIG. 1.

Turning now to the annexed drawings in greater detail and referring first to FIGS. 1 through 3, therein illustrated is a pump-attached dipole electro-plating barrel embodying the present invention and generally comprised of two opposite frames designated by the numerals 1 and 1', a triple of positioning posts generally designated by the numeral 11 disposed between the two opposite frames 1 and 1' and fixedly secured thereto by respective screw bolts 12 defining therewith a space for setting therein of a cylinder 2 within the triple of positioning posts 11. The cylinder 2 is comprised of a hexad of plastic boards respectively connected together forming a hexagonal body and defining therebetween a plurality of obtuse angle portions 20. The plastic boards of the cylinder 2 has plurality of small holes thereon, which small holes are internally attached with a mesh cloth (not shown). A hexad of electrodes 21 are equally and fixedly positioned in the cylinder 2 at the obtuse angle poritons 20 (see FIG. 3), with one ends protruding beyond one end wall portion 22 of the cylinder 2. An unitary hood 23 which serves as a water guard is made on the cylinder 2 circumferentially upstanding from the end wall portion 22, such that the internal portion of the cylinder 2 is blocked up from the hood 23 by the end wall portion 22. A water proof cover 25 is fixedly covered on the hood 23 with a water seal ring 24 squeezed therebetween to provide water tight effect. The water proof cover 25 has thereon a center hole 251 for insertion therein of a socket 26 which has a check flange 261 stopped at the back side of the water proof cover 25, and an outer thread 262 protruding beyond the water proof cover 25 to screw up with the inner thread 271 of a screw nut 27. Thus, the socket 26 and the screw nut 27 are fixedly connected to the cylinder 2 serving as its shaft collar. The socket 26 has a circular groove 263 with a shaft seal packing 264 mounted thereon. A shaft element 28 is secured to the socket 26 by the shaft seal packing 264 and the screw nut 27, which shaft element 28 has its one end inserted through a hole 101 on the frame 1 with its outer thread portion 281 screwed up with the inner thread 291 of a screw nut 29 to become firmly secured to the frame 1. A double-line cable is inserted into the shaft element 28 hermetically with its two terminals 282 and 283 projecting therefrom in the front. The opposite two ends of the double-line cable are extending out of the frame 1 for connection to a pair of conducting arms 18 and 19 (one for cathode and the other for anode) so as to induce electric poles. The terminals 282 and 283 penetrate through the check flange 261 of the socket 26 into the inner space of the water proof hood 23 of the cylinder 2 to connect to a pair of copper rich carbon brushes 32 and 33 and an electric polarity changing device 3. The electric polarity changing device 3 comprises a carbon brush holder 31 having a center disc portion 310, which has thereon a pair of holes 311 and 312 for insertion therethrough of the two terminals 282 and 283 to connect to the lead wires 321 and 331 of the two carbon brushes 32 and 33, and two opposite rail portions 313 and 314 respectively extending from the center disc portion 310, which rail portions 313 and 314 have grooves 315 and 316 in the middle for insertion therethrough of screws 317 and 318 to connect two plate springs 322 and 332 which are respectively mounted on the two carbon brushes 32 and 33. The screws 317 and 318 may be displaced in the grooves 315 and 316 to adjust the contact area between electric distributor 35 and carbon brushes 32 and 33 so as to change the contact number of electodes. The tightness between carbon brushes 32 and 33 electric distributor 35 is controllable through adjusting the shift nuts 29 and 29' to set the spring force of two plate springs 322 and 332. The carbon brush 32 which is disposed at an upper position is slightly smaller than the carbon brush 33 which is disposed at a lower position, i.e., the upper carbon brush 32 is for connection thereto of the positive electricity so as to serve as a anode, and the lower carbon brush 33 is for connection thereto of the negative electricity so as to serve as a cathode. The two carbon brushes 32 and 33 are constantly kept in contact with an electric distributer 35. The electric distributer 35 is comprised of a plurality of fan-shaped copper pads 351 respectively arranged at equal circumferential pitch to form a disc-like structure with insulators 352 respectively squeezed therebetween. The fan-shaped copper pads 351 are respectively coupled with the electrodes 21 of the cylinder 2 beyond the end wall portion 22 within the water proof hood 23. During rotation of the cylinder 2, the electric distributor 35 is carried to rotate synchronously, and the anode and cathode are respectively induced through the two terminals 282 and 283 via the two carbon brushes 32 and 33 to periodically act on each one of copper pads of electric distributor 35. Therefore, during plating process, the electrodes 21 of the cylinder 2 are disposed to alternatively connect with the two carbon brushes 32 and 33 for induction of anode or cathode. During cathode status, the electrodes 21 are turned to a lower position to act on a working piece. When at anode status, the electrodes 21 are turned to an upper position, and the deposited which is attached onto the electrodes 21 will be automatically electrolyzed back to electro-plating solution. Thus, the dimension of the electrodes 21 will not be build-up, high efficiency of cathode current and longer service life of the electrodes 21 can be achieved, and the consumption of anode metal or metal ion in electro-plating solution can be minimized.

Figure 4:
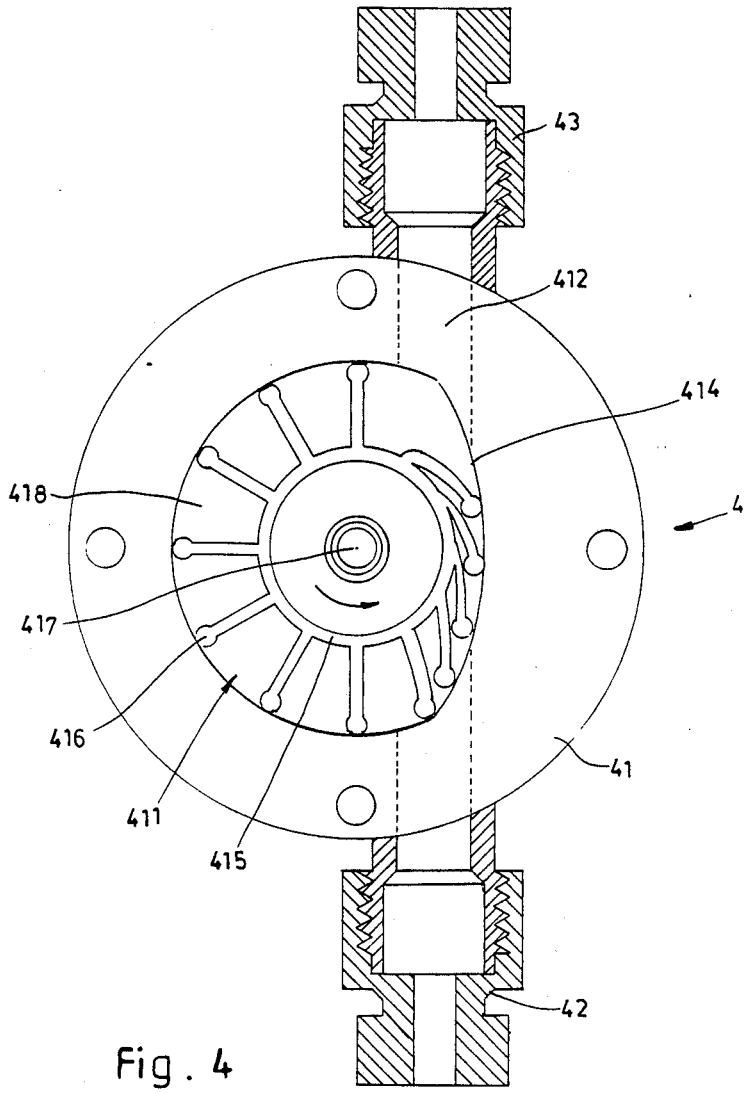
FIG. 4 is a sectional view of flexible impeller vane pump constructed according to the present invention.

The cylinder 2 has an end gear portion 221' on the other end wall portion 22' opposite to the end wall portion 22 and engaged with a speed change gear 222' which is mounted on the frame 1' and driven to rate by a motor power source. Through the speed change gear 222', the cylinder 2 can be carried to rotate by such a motor power source. Further, a flexible impeller vane pump 4 (see FIG. 2) is fixedly mounted on the frame 1' at its outer side, which pump 4 comprises a packing 420, a housing 41 having two conduit pipes 42 and 43 respectively extending therefrom (see FIG. 4), in which, the conduit pipe 42 is for water feeding and dipped in an electro-plating solution; the conduit pipe 43 is for discharging and penetrating through the central axis of the cylinder 2. The housing 41 of the pump 4 defines therein a hollow space 411, and a passage 412 through such a hollow space 411. The hollow space 411 is relatively eccentric to the passage 412 and defining therewith a guide wall portion 414. An vane-like member 415 which comprises an axle 417 having thereon a plurality of radial rubber blades 416 is positioned in the hollow space 411 with its axle 417 inserted through the frame 1' and connected to a driven gear 419 which is internally mounted on the frame 1' and engaged with the end gear 221' of the cylinder 2. Thus, through the rotation of the cylinder 2, the rubber blades 416 of the vane-like member 415 are simultaneously carried to rotate. Because there are spaces 418 between the rubber blades 416, the spaces 418 may be alternatively turned to a position corresponding to the conduit pipe 42, during the rotation of the vane-like member 415, permitting the electro-plating solution be pumped up from the conduit pipe 42 through the spaces 418 into the cylinder 2 via the conduit pipe 43. Therefore, the concentration and activity of the electro-plating solution inside the cylinder 2 can be constantly maintained at a level equal to the electro-plating solution outside the cylinder 2.

I claim:

1. A pump-attached dipole electro-plating barrel, including:

a cylinder mounted on two opposite supporting frames and driven to rotate by a motor through a speed change gear, said cylinder having positioned therein a hexad of electrodes, an unitary hood circumferentially upstanding from an end wall portion thereof covered with a water proof cover and sealed with a water packing therebetween, said water proof cover having thereon a center hole mounted with a socket serving as a shaft collar for connection thereto of a shaft element, said shaft element being secured to a first support frame and having inserted therein hermetically a double-line cable, said double-line cable having its one end respectively connected to a anode conducting arm and a cathode conducting arm and having its other end coupled with two terminals, said two terminals being disposed to penetrate through said socket into said water proof hood to further connect to an electric polarity changing device, said electric polarity changing device including a carbon brush holder connected with said two terminals, two carbon brushes, and an electric distributor, said electric distributor being comprised of a plurality of fan-shaped copper pads respectively arranged in equal circumferential pitch to form a disc-like structure with insulators respectively squeezed therebetween, said fan-shaped copper pads being respectively coupled with said electrodes to follow said cylinder to rotate so as to alternatively induce the positive and negative electricity through said two teminals to said electrodes; and a flexible impellar vane pump mounted on a second supporting frame to equalize the electro-plating solution in said cylinder with that outside said cylinder.

2. An electro-plating barrel according to claim 1, wherein said carbon brush holder of said electric polarity changing device comprises a center disc portion, which has thereon a pair of holes for insertion therethrough of said two terminals to connect to the lead wires of said two carbon brushes, and two opposite rail portions respectively extending from said center disc portion, said rail portions having grooves in the middle for insertion therethrough of screws to adjustably connect two plate springs which are respectively mounted on said two carbon brushes so as to adjust the position of said two carbon brushes in contact with said electric distributer to arrange the contact number of electrodes. trodes.

3. An electro-plating barrel according to claim 2, wherein said two carbon brushes include a smaller one disposed at an upper posiiton for connection thereto of the positive electricity to serve as a anode, and a larger one disposed at a lower position for connection thereto of the negative electricity to serve as a cathode.

4. An electro-plating barrel according to claim 3, wherein said two carbon brushes include a larger one disposed at an upper position for connection thereto of negative electricity to act as a cathode, and a smaller one disposed at a lower position for connection thereto of positive electricity to act as a anode for the plating of working pieces of which density is smaller than bath.

5. An electro-plating barrel according to claim 1, wherein said cylinder is a hexagonal body having obtuse angle portions for setting therein of six independent electrodes.

6. An electro-plating barrel according to claim 1, wherein said flexble impellar vane pump is driven by an end gear of cylinder to pump outside electro-plating solution into said cylinder.

* * * * *